United States Patent [19]

Cemel et al.

[11] 4,233,363

[45] Nov. 11, 1980

[54] POLYESTER DRAW-TEXTURING FEED YARNS

[75] Inventors: Albert Cemel; Castulo Chaban, Jr., both of Chattanooga, Tenn.; Albert Z. Fresco, Martinsville, Va.

[73] Assignee: E. I. Du Pont de Nemours and Company, Wilmington, Del.

[21] Appl. No.: 17,072

[22] Filed: Mar. 2, 1979

[51] Int. Cl.[2] ..... D02G 3/00

[52] U.S. Cl. ..... 428/373; 57/243; 428/364; 428/369; 428/374

[58] Field of Search ..... 428/364, 373, 374, 369, 428/370, 371; 57/243, 245, 246

[56] References Cited

U.S. PATENT DOCUMENTS

| | | | |
|---|---|---|---|
| 3,593,513 | 7/1971 | Reese | 428/373 |
| 3,681,910 | 8/1972 | Reese | 428/373 |
| 3,771,307 | 11/1973 | Petrille | 57/288 |
| 3,772,872 | 11/1973 | Piazza et al. | 57/243 |
| 3,998,042 | 12/1976 | Reese | 428/369 X |
| 4,019,311 | 4/1977 | Schippers | 428/399 X |
| 4,059,949 | 11/1977 | Lee | 428/373 X |
| 4,118,534 | 10/1978 | Stanley | 428/374 X |
| 4,157,419 | 6/1979 | Mirhej | 428/373 |

OTHER PUBLICATIONS

Fresco et al., *Chemiefasern/Textil—Industrie,* Feb. 1977, pp. 149–153 and E 26–27.

*Primary Examiner*—Lorraine T. Kendell

[57] ABSTRACT

A draw-texturing feed yarn that is new in that it is a heather feed yarn, i.e., is suitable for draw-texturing to form textured yarns that are suitable for making fabrics having a uniform fine heather tone, comprising spin-oriented filaments of two differently-dyeable polyesters. The different component filaments are well mixed to a degree indicated by a new measurement termed DCM (Degree of Component Mixing). The different component filaments preferably have a balanced stress ratio (SR), i.e. the ratio of their stresses at the strain corresponding to the draw ratio undergone during draw-texturing is about 0.8 to about 1.2. Preferred components are homopoly(ethylene terephthalate) and cationic-dyeable copolyester. The heather feed yarns may be prepared by cospinning, with suitable arrangement of spinneret orifices and selection of suitable features, especially polymer viscosities.

5 Claims, 8 Drawing Figures

FIG. 5
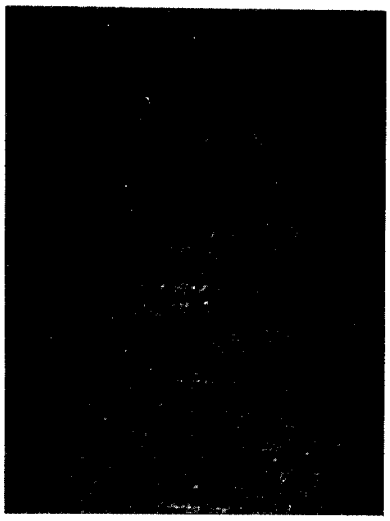
FIG. 6
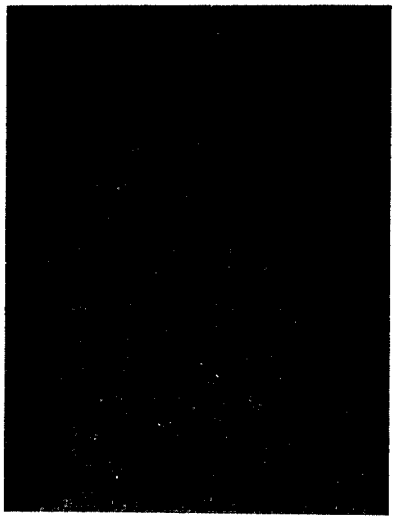
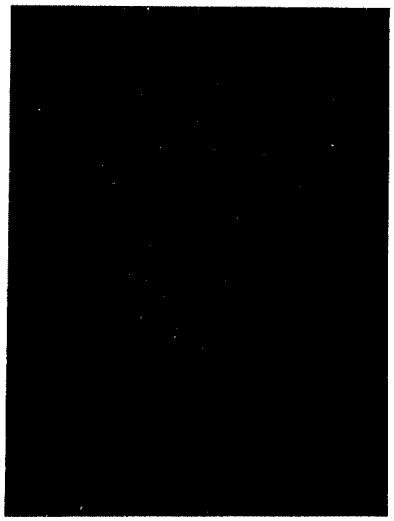
FIG. 7
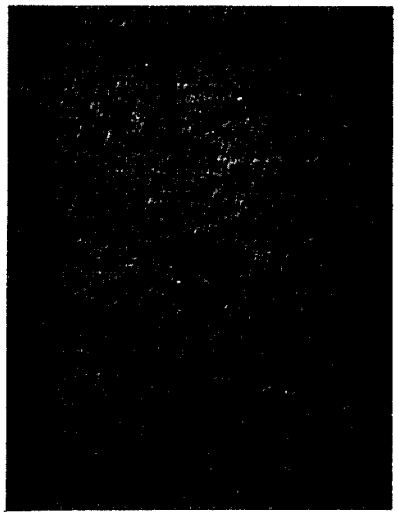
FIG. 8

POLYESTER DRAW-TEXTURING FEED YARNS

DESCRIPTION

TECHNICAL FIELD OF THE INVENTION

This invention relates to new synthetic polyester feed yarns for draw-texturing, and is more particularly concerned with a new heather feed yarn, i.e. a composite feed yarn comprising two types of continuous spin-oriented filaments and having the capability of being draw-textured to provide a textured yarn for making fabric of fine uniform heather appearance.

BACKGROUND

Synthetic polyester continuous filament yarns are textured to improve their aesthetics, i.e. tactility and covering power. False-twist texturing is the preferred commercial method of texturing.

It has been suggested by Reese in U.S. Pat. No. 3,593,513 that polyester yarns of mixed-color appearance, suitable for fabrics of a uniform attractive heather appearance, be prepared by cospinning or separately spinning filaments of poly(ethylene terephthalate) (2G-T or homopolymer) and of poly[ethylene terephthalate/ (5-sodium sulfo) isophthalate] (2G-T/SSI or copolymer), combining the filaments into a single yarn and drawing the filaments as an integral yarn to give a drawn yarn having a degree of filament intermingling (DFI) of at least 65%, preferably at least 80%, and a difference in (break) elongation ($E_B$) not exceeding 15% (a low $\Delta E_B$). The drawn yarns may be interlaced. The yarns may be textured like other drawn polyester yarns. Because of the significant difference in dye affinity between the two polyester components, which is well known, fabrics containing such yarns may be dyed to give a pleasing heather appearance. Such yarns are, therefore, referred to as heather yarns and have achieved commercial success as mentioned by Fresco et al. in Chemiefasern/Textil-Industrie, February 1977, 149–153 and E26–27. The difference in $E_B$ may be controlled by proper selection of relative viscosity (RV) for each polymer class. The RV of the 2G-T should be about 6 units higher than that of the 2G-T/SSI to obtain the desired similarity of elongation; 6 units of RV are almost equivalent to 5 units of HRV used herein.

It has been suggested by Petrille in U.S. Pat. No. 3,771,307 and by Piazza and Reese in U.S. Pat. No. 3,772,872 that spin-oriented polyester yarns, i.e. yarns that have been prepared by high speed spinning, be used as feed yarns in a draw-texturing process. These processes have been adopted commercially, on a large scale, and the literature contains many tributes to the economic and other advantages of preparing spin-oriented feed yarns and draw-texturing such feed yarns over the previous commercial practice of texturing fully drawn feed yarns that have been oriented by drawing yarns spun at lower spinning speeds.

Spin-oriented feed yarns and drawn feed yarns can generally be distinguished by their different (break) elongations and birefringences. Fully-drawn yarns have a low elongation, of the order of 30%, and significantly less than 50%, and a high birefringence, significantly more than 0.150. The elongation of a spin-oriented yarn decreases with the spinning speed, and the birefringence increases with the spinning speed, but commercial spin-oriented yarns have had significantly higher elongation, and significantly lower birefringence than commercial fully-drawn yarns.

Satisfactory spin-oriented heather draw-texturing feed yarns have not yet been produced, although it has long been possible to make spin-oriented analogs of the drawn component filaments of commercial heather yarns. Attempts to make dyed fabrics of acceptable fine uniform heather from such spin-oriented analogs have not hither-to been successful, because such fabrics have shown an undesirable streaky appearance, which is referred to as "directionality."

The present invention provides a new feed yarn that has the capability of being draw-textured to provide textured yarn that may be used to provide fabric of fine uniform heather appearance, and so may be referred to as a heather feed yarn.

SUMMARY OF THE INVENTION

The present invention provides a continuous filament polyester spin-oriented draw-texturing feed yarn with the improvement, whereby the feed yarn may be draw-textured to provide a textured yarn for making fabric having a fine uniform heather appearance, that the yarn comprises polyester spin-oriented filaments (a) of one type having affinity for one class of dyestuffs, and (b) of another type having affinity for a different class of dyestuffs, and that the degree of component mixing (DCM) of the different types of filaments is at least 49%, provided that, if the DCM is less than 50%, the stress-ratio (SR) of the different types of filaments is closely matched. The yarns are preferably interlaced.

The new heather feed yarns are distinguished from commercial drawn heather yarns by being spin-oriented, by having a higher elongation, preferably 50% to 150%, and by having a lower birefringence. Thus, the present invention provides a new heather feed yarn comprising polyester filaments of birefringence less than 0.130.

Preferred yarns comprise one type of polyester consisting of poly(ethylene terephthalate) and the other consisting of a polymer containing about 97 to 99 mole % of ethylene terephthalate structural units and about 1 to 3 mole % of polymer structural units containing sulfonate groups as pendant parts of repeating units in the polymer chain, particularly poly[ethylene terephthalate/(5-sodium sulfo) isophthalate].

The degree of component mixing (DCM) is a newly-coined term that is defined in more detail hereinafter. It is measured in a manner essentially similar to that for degree of filament intermingling (DFI), the main difference being that the DCM measurement requires consideration of each individual filament separately, the proportion of neighbour filaments that are of opposite type being noted for each filament, and then totaled separately for each type of filament, whereas, for the DFI, one merely considers the total number of filaments of each type that have a neighbour of the opposite type.

The stress ratio (SR) is also defined in more detail hereinafter. It is the ratio of the stresses of the component filaments when measured at a strain corresponding to the draw ratio during draw-texturing of the feed yarn. It is important to balance the stresses of the component filaments closely when the DCM is less than 50%, i.e. it is important to have an SR close to unity. When the DCM is more than 50%, the SR need not be so closely matched, but is preferably about 0.8 to about 1.2.

TABLE 1

| EXAMPLES | COUNT | B.T.°C. | HRV (CO/HO) |
|---|---|---|---|
| 1 | 240 - 34 | 298° | 14.1/21.5 |
| 2 | 240 - 34 | 300° | 13.0/20.4 |
| 3 | 240 - 34 | 300° | 12.9/20.4 |
| 4 | 240 - 34 | 300° | 13.0/21.6 |
| 5 | 240 - 34 | 300° | 13.1/20.8 |
| 6 | 245 - 34 | 290° | 13.4/20.0 |
| 7 | 245 - 34 | 290° | 13.4/21.4 |
| 8 | 240 - 34 | 300° | 13.1/21.5 |
| 9 | 240 - 34 | 290° | 15.2/21.5 |
| 10 | 175 - 20 | 295° | 13.2/21.7 |
| 11 | 160 - 34 | 295° | 13.1/21.3 |
| 12 | 175 - 20 | 286° | 13.1/21.5 |
| 13 | 175 - 20 | 282° | 13.4/21.5 |
| 14 | 180 - 20 | 287° | 13.5/20.0 |
| 15 | 175 - 20 | 286° | 13.1/21.5 |
| 16 | 160 - 34 | 295° | 13.3/21.1 |
| 17 | 115 - 34 | 290° | 13.6/20.6 |
| 18 | 115 - 34 | 295° | 13.3/21.4 |
| 19 | 175 - 20 | 282° | 13.4/21.5 |
| 20 | 175 - 20 | 295° | 13.2/21.7 |

TABLE 2

| EXAMPLES | DCM % | SR | DFI % | $\Delta E_B$ % | $E_B$ % |
|---|---|---|---|---|---|
| 1 | 48.4 | 1.14 | 92 | −6 | 116 |
| 2 | 47.0 | 0.98 | 91 | +7 | 126 |
| 3 | 47.0 | 1.14 | 96 | +2 | 133 |
| 4 | 49.0 | 0.91 | 93 | +3 | 123 |
| 5 | 49.0 | 1.12 | 92 | −5 | 127 |
| 6 | 53.0 | 1.15 | 96 | +2 | 125 |
| 7 | 53.1 | 1.09 | 94 | +5 | 119 |
| 8 | 49.0 | 1.01 | 92 | +5 | 129 |
| 9 | 52.3 | 1.20 | 94 | +7 | 126 |
| 10 | 50.6 | 1.01 | 95 | −2 | 129 |
| 11 | 50.0 | 0.95 | 95 | −5 | 108 |
| 12 | 53.6 | 0.95 | 96 | +6 | 126 |
| 13 | 53.5 | 1.02 | 95 | −1 | 110 |
| 14 | 52.0 | 1.18 | 98 | +8 | 130 |
| 15 | 57.5 | 1.16 | 96 | +8 | 134 |
| 16 | 53.5 | 1.09 | 95 | +3 | 107 |
| 17 | 51.7 | 1.03 | 95 | +7 | 121 |
| 18 | 54.6 | 1.05 | 96 | +7 | 106 |
| 19 | 57.7 | 1.13 | 97 | +6 | 111 |
| 20 | 55.0 | 1.07 | 96 | −2 | 113 |

The feed yarns were all draw-textured on a Leesona 955 stretch texturing machine under the same conditions. The temperature of the top three heaters was maintained at 200° C.±2. The lower three heaters were not used. The rolls were operated at the following speeds: top: 103±2, bottom: 64.5±1 ypm (corresponding to 94±2 and 59±1 m/min). The draw ratio was 1.596. The equivalent of 60 twists per inch (corresponding to about 24 twists per cm) was inserted into the yarn.

The draw-textured yarns were made into single-knit tubings (referred to as "Lawson tubes") using a Model 68 Lawson-Hemphill Fiber Analysis Knitter fitted with a 3.5 inch (8.9 cm) head at a feed rate of 4.0 (8:1 gear ratio). The fabrics were dyed in a dye beck using Sevron Blue 5G (1.8%) dye. Dye solutions were made up using 2 ml dye/gm fabric and 10 gm/liter of Latyl Carrier A. The pH was adjusted to 4.5–5.5 with 20% acetic acid. The fabrics were put into the cold dye solution, brought to a slow boil, boiled for 1 hour and dried. Samples were cut and wrapped onto 3¾ inch (9.5 cm) wide cardboard strips for viewing.

The uniformity of the heather appearance of all these samples was rated by seven people with experience in evaluating heather fabrics and the Examples have been listed in order of increasing heather uniformity from 1 to 20, it being understood that some samples were judged to be of similar uniformity. Photographs of the fabrics of Examples 5, 6, 8 and 20 are shown in FIGS. 5, 6, 8 and 7, respectively.

The fabrics of Examples 1–5, were not considered to have an acceptable uniform fine heather because of the streaks that were readily observed. These streaks are shown in FIG. 5 for the fabric of Example 5, which was considered marginally the best of these five fabrics which were somewhat comparable. The fabrics of Examples 6–9 were considered acceptable, despite the presence of some streaks that did not detract greatly from the overall heather apperance, as shown in FIGS. 6 and 8 for the fabrics of Examples 6 and 8, respectively. The fabrics of Examples 10 to 20 were considered to have good increasing to excellent fine heather uniformity, an excellent heather fabric being shown, for example, in FIG. 7 for the fabric of Example 20.

It will be noted that an acceptable heather rating on a Lawson tube generally correlates with a feed yarn having a DCM of 50% or more. For this reason, a DCM of 50% or more in the feed yarn is preferred. Some feed yarns having a DCM slightly less than 50% also give acceptable heather textured yarn fabrics, however. For instance, the feed yarn of Example 8 gave a Lawson tube having acceptable heather, as shown in FIG. 8, despite the fact that the DCM of the feed yarn was only 49%, i.e. slightly less than 50%; it will be noted that this feed yarn has a closely matched stress ratio of 1.01, and such feed yarn is, therefore, according to the present invention. In contrast, the feed yarns of Examples 4 and 5 gave Lawson tube fabrics with unacceptably streaky heather, as shown in FIG. 5 for the fabric of Example 5; it will be noted that, although the DCM values of these feed yarns of Examples 4 and 5 were also 49%, the SR values (1.12 and 0.91%) were not closely-matched, and so these feed yarns are not according to the invention. The feed yarn of Example 2 has a DCM value of only 47% and gave an unacceptably streaky heather textured yarn fabric, although the SR of the feed yarn is closely matched (0.98).

As the DCM rises towards 50%, the SR need not be so closely matched as in Example 8. The SR is preferably reasonably matched even when the DCM is higher than 50% (especially if the DCM is close to 50%). It can, however, be noted that good heather uniformity can be obtained, even when the SR is not closely-matched, if the DCM is sufficiently high (52% in the case of Example 14, which gave a fabric of excellent heather uniformity despite an SR of 1.18).

It will also be noted that acceptable heather does not necessarily result from a good (high) DFI and low $\Delta E_B$ of the feed yarns. Examples 1 to 3 have DCM values of 47% or less, which account for the streaky appearance of the resulting fabrics, despite the high DFI values and low $\Delta E_B$ of the feed yarns. For instance, the feed yarn of Example 3 has a DFI of 96%, but gives an unacceptable heather fabric, despite having filaments with closely matching $E_B$ ($\Delta E_B=2$), because the DCM is only 47%.

It should be understood that the heather effect in a fabric can be varied even for the same feed yarn, by varying the fabric construction and the texturing conditions, for example. The feed yarns of the invention have the capability of being draw-textured to give yarns that can be used to give fabrics of at least acceptable heather uniformity, but use of such feed yarns does not necessarily ensure that all resulting textured yarns, textured under widely varying conditions, will give a fabric that will inevitably have acceptable heather uniformity. When considering the different feed yarns in relation to their heather ranking in Table 2, it should also be borne in mind that the number and denier of the filaments will affect the heather ranking of a fabric.

COUNT

The first figure is the denier of the feed yarn. The second figure is the number of filaments.

Thus, Example 1 was a feed yarn of total denier 240 and 34 filaments.

B.T.° C

This is the temperature of the spinneret block.

HRV

This indicates the relative viscosities (HRV) of the yarns, that of the copolymer (CO) being given first. The HRV is the ratio of the viscosity of a solution of 0.78 gram of the filament dissolved in 10 ml of hexafluoroisopropanol containing 100 ppm $H_2SO_4$ to the viscosity of the hexafluoroisopropanol containing $H_2SO_4$, both measured at 25° C. in a capillary viscosimeter and expressed in the same units.

DCM—Degree of Component Mixing

As indicated, this is a more sensitive measure on essentially the same lines as the DFI (degree of filament intermingling) measurement referred to above, and will be explained with reference to FIGS. 2, 3 and 4, each of which illustrates an enlargement of a cross-section of a typical bundle of yarn whose filaments have been differentially dyed and mounted as follows.

Ten cross-section samples are prepared by taking 10 inch (25 cm) lengths of yarn (each spaced by about 1 meter from the next sample) and twisting each several turns to maintain bundle integrity. Care must be taken to minimize disturbance of the filaments. The ends of each sample are then attached to opposite ends of a rectangular frame using suitable tape or clamps. Care is taken to make sure the samples are taut but not stretched. The samples are then dipped into a lacquer for about ten minutes and taken out to dry for at least two hours and preferably overnight. The lacquer "freezes" the filaments so that their relative positions will not be disturbed in subsequent steps. Each sample is then cut to proper length and mounted in a holder. Molten wax is added, thus encapsulating the samples. After allowing about one hour to dry, the wax plugs are mounted in a microtome and cross-section samples of suitable thickness (about 8 μm) are cut from each sample. Each of the ten sets of cuttings is placed on separate microscope slides coated with albumin. After drying the slides on an 80° C. hot plate for one hour they are run through a xylene bath for 15–20 minutes to remove excess wax. After drying, the slides are placed in a frame, immersed in a Sevron Blue 5G (1.8%) dye bath at about 90° C. for 5–10 minutes, rinsed in a container of water, and then allowed to dry. The samples are now ready to be viewed in a microscope. Photographs of the cuttings are taken for the DCM readings. This procedure is repeated for each of the ten slides to give the DCM.

To obtain a DCM reading, the following procedure is followed. Each light filament is considered separately. All other filaments which touch, or which would touch by mere straight line translation, this light filament, (i), are termed "nearest neighbours" and are totalled ($\eta_{it}$). The number of such nearest neighbours that are dark ($\eta_{id}$) is totalled, and the proportion of such nearest neighbours that are dark is calculated ($\eta_{id}/\eta_{it}$). The sum of these proportions ($\eta_{id}/\eta_{it}$) for all the light filaments is $\Sigma l = \Sigma(\eta_{id}/\eta_{it})$. $\Sigma l$ is divided by the total number of light filaments ($\eta_{lt}$) to give a quantity $Q_l = \Sigma l/\eta_{lt} = \Sigma(\eta_{id}/\eta_{it})/\eta_{lt}$. A similar count in reverse is made for all the individual dark filaments, i.e. the proportions of their nearest neighbours that are light, to get a sum $\Sigma d = \Sigma(\eta_{jl}/\eta_{jt})$ and a quantity $Q_d = \Sigma_d/\eta_{dt} = \Sigma(\eta_{jl}/\eta_{jt})/\eta_{dt}$. A DCMR (DCM reading) is half the sum of these quantities expressed as a percentage, i.e.:

$$50(Q_l + Q_d) = 50\left[\frac{\Sigma l}{\eta_{lt}} + \frac{\Sigma d}{\eta_{dt}}\right] = \left[\frac{\Sigma\left(\frac{\eta_{id}}{\eta_{it}}\right)}{\eta_{lt}} + \frac{\Sigma\left(\frac{\eta_{jl}}{\eta_{jt}}\right)}{\eta_{dt}}\right] \times 50$$

$\eta_{id}$ = dark nearest neighbours about light "i"

$\eta_{it}$ = total nearest neighbours about light "i"

$\eta_{lt}$ = total light filaments $\eta_{jl}$ = light nearest neighbours about dark "j"

$\eta_{jt}$ = total nearest neighbours about dark "j"

$\eta_{dt}$ = total dark filaments $\Sigma l$ = sum of proportions ($\eta_{id}/\eta_{it}$) of nearest neighbours that are dark about light filaments $\Sigma d$ = sum of proportions ($\eta_{jl}/\eta_{jt}$) of nearest neighbours that are light about dark filaments $Q_l = \Sigma l/\eta_{lt}$ quantity for light filaments $Q_d = \Sigma d/\eta_{dt}$ quantity for dark filaments It must be recognized that the DCM readings will vary somewhat along a yarn sample. This is why at least ten samples, spaced 1 meter apart, are used. The actual DCM is the average of these samples. More extensive DCM determinations would be expected to give a bell-shaped type distribution. In general, therefore, most DCM readings will fall within ±5% of the average, but, occasionally, a sample gives an "extreme" value varying >±10% of the average. With only ten samples, this could lead to misinterpretation, particularly in borderline cases. For example, if nine samples gave an average DCM of 51% while the tenth sample gave a DCM of only 40%, the gross average would be 49.9%, which is below the 50% limit preferred for acceptable heather. In reality, however, this yarn would give an acceptable heather. When a DCM value varying >±10% of the average is encountered, therefore, one should discard that value and recalculate the average of the remaining samples. An additional set of cross-sections can be prepared so as to obtain the average over twenty samples, but this procedure is very time consuming.

The DCM reported is, therefore, an average, usually of 10 such DCMR readings, to compensate for the inevitable variation in DCMR readings along any threadline.

Table 3 shows a DCMR calculation for each of the cross-sections shown in FIGS. 2, 3 and 4, by way of illustration. The numbered filaments are considered separately and the nearest neighbours of each are determined, with the proportion of the opposite color being given after the number of each filament. Thus: light filament 4 has five nearest neighbours, four of which are dark; dark filament 1 has two nearest neighbours but none is light.

TABLE 3

| FIG. 2 | | FIG. 3 | | FIG. 4 | |
|---|---|---|---|---|---|
| Light $\frac{\eta_{id}}{\eta_{it}}$ | Dark $\frac{\eta_{jl}}{\eta_{jt}}$ | Light $\frac{\eta_{id}}{\eta_{it}}$ | Dark $\frac{\eta_{jl}}{\eta_{jt}}$ | Light $\frac{\eta_{id}}{\eta_{it}}$ | Dark $\frac{\eta_{jl}}{\eta_{jt}}$ |
| 4 4/5 | 1 0 | 4 5/6 | 1 ⅓ | 4 2/2 | 1 ⅓ |
| 7 2/4 | 2 0 | 6 ⅔ | 2 ⅓ | 5 ¾ | 2 ⅓ |
| 8 0 | 3 2/4 | 7 3/7 | 3 ¾ | 7 5/6 | 3 2/4 |
| 11 3/6 | 5 ⅔ | 9 2/4 | 5 2/4 | 10 4/6 | 6 4/5 |
| 13 ¼ | 6 3/5 | 11 4/6 | 8 5/6 | 11 4/6 | 8 2/5 |
| 15 2/5 | 9 0 | 12 2/5 | 10 ¾ | 17 3/3 | 9 ⅔ |
| 16 2/6 | 10 2/6 | 13 2/6 | 15 ⅓ | 18 ½ | 12 3/6 |
| 18 ⅔ | 12 4/6 | 14 0 | 16 ⅓ | 19 2/4 | 13 ⅓ |
| 19 0 | 14 ⅓ | 18 ⅓ | 17 4/5 | 20 ⅔ | 14 3/5 |
| 20 ⅓ | 17 ¾ | | | | 15 4/6 |
| | | | | | 16 3/5 |
| $\Sigma_l$ 3.78 | $\Sigma_d$ 3.85 | $\Sigma_l$ 4.16 | $\Sigma_d$ 4.97 | $\Sigma_l$ 6.58 | $\Sigma_d$ 5.73 |
| $Q_l$ .378 | $Q_d$ .385 | $Q_l$ .462 | $Q_d$ .552 | $Q_l$ .731 | $Q_d$ .521 |
| DCMR = 38.2% | | DCMR = 50.7% | | DCMR = 62.6% | |
| DFI = 75% | | DFI = 95% | | DFI = 100% | |

DFI—Degree of Filament Intermingling

This is measured as described in Reese U.S. Pat. No. 3,593,513 on the same samples prepared for the DCM determinations. The following formula may be used, with the terminology for the DCM above, and where $\eta_l$ is the number of light filaments which have one or more dark filaments among their nearest neighbours, and $\eta_d$ is the number of dark filaments which have a light filament among their nearest neighbours.

$$DFI\ (\%) = 50\left[\frac{\eta_l}{\eta_{lt}} + \frac{\eta_d}{\eta_{dt}}\right]$$

Stress—Ratio (SR)

The following test was used for measuring the stress-ratio (SR) of the filaments in the yarns described in the Examples herein, such yarns having been prepared by high speed cospinning at 3400 ypm (3100 m/min) for drawtexturing at a draw ratio of about 1.6×, i.e. an elongation of 60%. The stress-ratio is measured on the individual filaments and not on the whole yarn, and so the yarn is first separated into its individual filaments. Each filament is strained on an Instron machine until the filament breaks, the stress being recorded automatically, using a distance between clamps of 2 inches and a rate of elongation of 2 inches/min (2 inches=5.08 cm). The stress at 60% elongation (strain) is noted for each filament and these stresses are recorded separately for each type of filament. The different types are generally easily recognizable by their different stress-strain curves, but, for convenience, a portion of the yarn may by dyed so as to differentiate the types, e.g. with a cationic dye; the dyed portion should not be tested, since dyeing will probably change the stress-strain properties.

The average stress for one type of filament, e.g. a copolymer, is calculated and divided by the average denier of these filaments in the feed yarn, i.e. before testing, to give the value $S_{CO}$, the similar value for the other type is determined, e.g. $S_{HO}$ for a homopolymer, and the stress ratio is calculated therefrom, i.e. $SR = S_{CO}/S_{HO}$.

As indicated, when the DCM is less than 50% it is important that SR be close to unity, i.e., the stresses be closely matched at the elongation to be used during draw-texturing. Since the stress-strain curves of the types of filaments may be widely different, because the types have been selected for their affinity to different classes of dyestuffs, it may require some experimentation to match the SR. The examples illustrate the preparation of filaments of matching SR.

Commercial draw-texturing feed yarns are prepared by spinning at a particular speed, at present 3400 ypm (3100 m/min), which corresponds to the particular draw ratio (usually about 1.6× at present) used in draw-texturing. The precise draw ratio varies slightly depending on the desires of individual throwsters, but this variation does not amount to more than about 0.1, e.g. from 1.6 to 1.7. If the draw-texturing is to be carried out at a different draw ratio, then, for preparation of satisfactory draw-textured yarns, the stress and stress ratio should be determined at the elongation (strain) corresponding to such draw ratio.

The birefringence indicates the orientation of the polymer chain segments. It may be measured as in British Pat. No. 1,406,810 (pages 5 and 6). The birefringence of the filaments in the Examples are all believed to be of the order of 0.04 or less, and are certainly believed to be within the range of 0.025 to 0.130.

$E_B$—Elongation

The (break) elongation of the feed yarns is measured on an Instron Machine with a distance between clamps of 6 inches and a rate of elongation of 6 inches/min (6 inches=15.2 cm).

The elongation ($E_B$) of the yarns is generally at least 50%, and is preferably 70% to 120%.

$\Delta E_B$—Differential Elongation

Differential elongation is measured using separately spun component yarns, if available, or with individual filaments using the stress-ratio test. In the latter case, the average filament elongation (at break) for each component is compared. In the former case the yarn samples are tested as indicated above; the differential elongation is calculated using the average elongation of 3 breaks per component yarn. The two methods generally agree within 2–3%. A positive $\Delta E_B$ indicates that the elongation of the copolymer is higher.

The feed yarns of the invention may vary from those described in the Examples. Although the yarns in most of the Examples comprised equal numbers of the different types of filaments, all of which were of similar denier, $TiO_2$ content and round cross-section, for example, the invention is not restricted only to such yarns. The numbers, $TiO_2$ content, cross-section and deniers of filaments need not be equivalent, but may vary, provided the DCM requirement is met. It will be understood that use of three types of filament, or more types, can give a further effect, and will involve modification of the DCM counts, described earlier, e.g., to provide for three colors, instead of merely two colors for the filaments, and, e.g., quantities $Q_1$, $Q_2$ and $Q_3$, correspondingly, in the formula expressing the DCMR. If desired, some of the filaments may be of a sheath-core structure, as disclosed, for example, in Lee U.S. Pat. Nos. 3,992,499 and 4,059,949. The denier of the filaments is generally a matter of aesthetic choice, and will generally vary from 1 to 10 denier per filament; mixed denier yarns may be desired for some purposes, provided the DCM requirement is met. Similarly other polymers may be used to obtain differently-colored filaments, and methods other than those shown in the Examples may be used to obtain the desired DCM and SR.

Similarly, the other process conditions can be varied. For instance, the yarns may be spun at a different speed to give a different orientation, for draw-texturing at a different draw ratio, and other modifications may be applied to vary the orientation. Considering the limitations of most present winding equipment, a draw ratio of less than 1.3× is unlikely unless very high speed windups are used, in which case the draw ratio could be lower, e.g. down to 1.1 or even close to unity. A draw ratio of more than 1.8× would mean spinning at lower spinning speeds, which are less desirable economically.

It is generally desirable to match the spinning tensions of the component filaments, e.g. within 0.025 grams per denier, since increasing the differential spinning tension tends to promote segregation of the filaments and lower the DCM, even when a well mixed spinnerest orifice pattern is used. The spinning tensions and draw tensions are affected by the choice of molecular weight (measured by relative viscosity), and to a lesser extent by capillary diameter, and to some extent by other spinning parameters, such as block temperature and the supply of cooling air. Preferred relative viscosities (HRV) are 26 to 19 for the homopolyester (HO) and 15 to 12.5 for the above copolyester (CO). Higher values tend to lead to poor texturing performance (excessive broken filaments) while lower values tend to give weaker filaments. These limits are known to those skilled in the art of preparing partially oriented yarns, and are matters of operability unrelated to the present invention, which is based on the recognition of the need to get a surprisingly high degree of individual filament mixing in the feed yarn, if it is to have the capability of being draw-textured to give textured yarn that may be used to provide fabrics of fine uniform heather appearance.

We claim:

1. A draw-texturing feed yarn with the improvement, whereby the feed yarn may be draw-textured to provide a textured yarn for making fabric having a fine uniform heather appearance, that the yarn comprises polyester spin-oriented filaments (a) of one type having affinity for one class of dyestuffs, and (b) of another type having affinity for a different class of dyestuffs, that the degree of component mixing (DCM) of the different types of filaments is at least 50%, and that the stress ratio (SR) of the different types of filaments is about 0.8 to about 1.2.

2. A yarn according to claim 1, having a break elongation of 50 to 150%.

3. A yarn according to claim 1, or 2, wherein one type is a polyester filament consisting of poly(ethylene terephthalate) and the other type is a filament consisting of a polymer containing about 97 to 99 mole % of ethylene terephthalate structural units and about 1 to 3 mole % of polymer structural units containing sulfonate groups as pendant parts of repeating units in the polymer chain.

4. A draw-texturing feed yarn with the improvement, whereby the feed yarn may be draw-textured to provide a textured yarn for making fabric having a fine uniform heather appearance, that the yarn comprises polyester filaments, of birefringence less than 0.130, (a) of one type having affinity for one class of dyestuffs, and (b) of another type having affinity for a different class of dyestuffs, that the degree of component mixing (DCM) of the different types of filaments is at least 50%, and that the stress ratio (SR) of the different types of filaments is about 0.8 to about 1.2.

5. A yarn according to claim 4, wherein one type is a polyester filament consisting of poly(ethylene terephthalate) and the other type is a filament consisting of a polymer containing about 97 to 99 mole % of ethylene terephthalate structural units and about 1 to 3 mole % of polymer structural units containing sulfonate groups as pendant parts of repeating units in the polymer chain.

* * * * *

United States Patent [19]

van Thiel

[11] 4,233,364

[45] Nov. 11, 1980

[54] ANCHORING FIBRE FOR USE IN CONCRETE

[75] Inventor: Rudolphus A. F. J. van Thiel, Beek en Donk, Netherlands

[73] Assignee: Van Thiel's Draadindustrie (Thibodraad) B.V., Beek en Donk, Netherlands

[21] Appl. No.: 39,211

[22] Filed: May 15, 1979

Related U.S. Application Data

[63] Continuation-in-part of Ser. No. 927,953, Jul. 25, 1978, abandoned.

[51] Int. Cl.[2] ..... D02G 3/00

[52] U.S. Cl. ..... 428/399; 52/659; 428/400

[58] Field of Search ..... 428/397, 399, 400, 379, 428/554, 582, 583, 584, 606, 603, 592, 364; 52/659

[56] References Cited

U.S. PATENT DOCUMENTS

| | | | |
|---|---|---|---|
| 3,053,713 | 9/1962 | Juras | 428/379 X |
| 3,313,560 | 4/1967 | Macchi | 403/333 |
| 3,553,003 | 1/1971 | Carlton et al. | 428/400 X |
| 3,592,727 | 7/1971 | Weaver et al. | 428/399 |
| 3,684,474 | 8/1972 | Chrisholm | 52/659 X |
| 3,846,085 | 11/1974 | Dunn, Jr. | 428/583 |
| 3,936,278 | 2/1976 | Moens | 428/592 |
| 3,942,955 | 3/1976 | Moens | 52/659 X |
| 3,953,185 | 4/1976 | Aoki et al. | 428/372 X |
| 3,953,953 | 5/1976 | Marsden | 428/603 |

FOREIGN PATENT DOCUMENTS

| | | | |
|---|---|---|---|
| 252975 | 6/1926 | United Kingdom | 52/659 |
| 1328568 | 8/1973 | United Kingdom . | |
| 1446855 | 8/1976 | United Kingdom | 52/659 |
| 1452303 | 10/1976 | United Kingdom . | |

*Primary Examiner*—Lorraine T. Kendell
*Attorney, Agent, or Firm*—Irvin A. Lavine

[57] ABSTRACT

An anchoring fibre of metal to be used in concrete, having a flattened end and a transversely extending projection on the end. The flattened end may be either rectangular or triangular in planform, and the projections may be either pyramidal or a flange. The body may have protuberances extending therefrom.

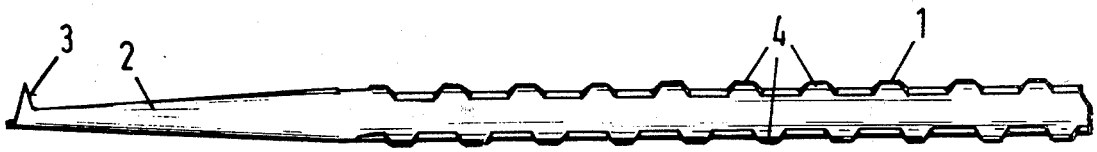

11 Claims, 4 Drawing Figures